US005365851A

United States Patent [19]

Shaw

[11] Patent Number: 5,365,851

[45] Date of Patent: Nov. 22, 1994

[54] INITIATOR DEVICE

[75] Inventor: Lester W. Shaw, Avon, Conn.

[73] Assignee: The Ensign-Bickford Company, Simsbury, Conn.

[21] Appl. No.: 926,832

[22] Filed: Aug. 7, 1992

[51] Int. Cl.[5] ..... F42C 19/12; F42B 19/08; F42D 1/04

[52] U.S. Cl. ..... 102/275.6; 102/275.5; 102/275.11

[58] Field of Search ..... 102/275.2–275.7, 102/275.11, 275.12

[56] References Cited

U.S. PATENT DOCUMENTS

| | | | |
|---|---|---|---|
| 2,475,281 | 7/1949 | Hanley | 102/275.9 |
| 3,129,663 | 4/1964 | Schnepfe, Jr. | 102/275.4 |
| 3,260,202 | 7/1966 | Bryla | 102/275.5 |
| 3,296,968 | 1/1967 | Shulman et al. | 102/275.4 |
| 3,460,477 | 8/1969 | Heidemann et al. | 102/275.3 |
| 3,590,739 | 7/1971 | Persson | 102/275.5 |
| 3,678,853 | 7/1972 | Kilmer | 102/275.4 |
| 3,792,660 | 2/1974 | Plumer | 102/275.5 |
| 3,981,240 | 9/1976 | Gladden | 102/275.5 |
| 3,987,732 | 10/1976 | Spraggs et al. | 102/275.5 |
| 3,990,367 | 11/1976 | Smith | 102/275.4 |
| 4,608,926 | 9/1986 | Stevens | 102/275.4 |
| 4,962,708 | 10/1990 | Snyder et al. | 102/275.6 |
| 4,998,477 | 3/1991 | Barker | 102/275.4 |
| 5,012,741 | 5/1991 | Peebles et al. | 102/275.4 |

FOREIGN PATENT DOCUMENTS

| | | |
|---|---|---|
| 0249329 | 6/1953 | Australia . |
| 0913747 | 12/1962 | United Kingdom . |
| 2140137 | 11/1984 | United Kingdom . |

*Primary Examiner*—David Brown
*Attorney, Agent, or Firm*—Victor E. Libert; Frederick A. Spaeth

[57] ABSTRACT

An initiation fixture (16) for an impulse transmission tube comprises a sleeve (30) having an internal longitudinal bore. The sleeve (30) is dimensioned and configured to receive a shock tube (10) in one end and a primer cap (28) in the other. An internal fence (32) establishes a touch hole (33) between the primer cap (28) and the end of the shock tube (10). In addition, primer cap (28) and the end of shock tube (10) are separated by an intervening isolation member (34) which disperses static electricity from shock tube (10) to prevent discharge across touch hole (33) to primer cap (28). A retainer means (40) is movably disposed on an exterior surface of sleeve (30) and is dimensioned and configured to engage a triggering device (18). A first stop means (42) allows retainer (40) to secure the end of sleeve (30) within the triggering device (18) and positions primer cap (28) for detonation by a striking pin (20). A second stop member (26) limits the longitudinal travel of retainer (40) and may be indexable for the user to vary the longitudinal travel of retainer (40) in sleeve (30). The fixture (16) may be equipped with the primer cap (28) and secured to a shock tube (10), which optionally also may have a detonator cap (14) secured to the opposite end.

17 Claims, 3 Drawing Sheets

INITIATOR DEVICE

BACKGROUND OF THE INVENTION

1. Field of the Invention

The present invention relates to the initiation of blasting or detonation signal transmission devices and more particularly to an initiation device suitable for end initiation of low-energy fuses such as signal transmission tubes.

2. Related Art

U.S. Pat. 5,012,741 to Peebles et al dated May 7, 1991 discloses an initiator for a transmission tube comprising a body having a passageway formed therein for retaining an initiator charge and a holder formed within the body for receiving a signal transmission tube and holding a side of the transmission tube in proximity to the initiator charge whereby, upon detonation of the initiator charge, a signal is initiated in the transmission tube through the side of the tube. This Patent discloses the use of a primer charge 33 to ignite a delay column composition 45 which in turn ignites an initiator charge 41 which pierces the signal transmission tube thereby initiating signal propagation in the tube. While this initiator, by initiating through the tube, maintains the tube sealed against the environment until the moment of initiation, it requires a charge of sufficient strength to rupture the initiation tube.

SUMMARY OF THE INVENTION

In accordance with the present invention there is provided an initiation fixture mounted on one end of an impulse transmission tube which is intended to carry an ignition signal to a detonator. The initiation fixture seals the open end of the tube against the elements. The initiation fixture may be configured to incorporate an initiating charge for igniting the impulse transmission tube, thereby avoiding the need to provide an initiating charge in an igniter device. In one aspect of the invention, the initiation fixture may be fixedly mounted to an impulse transmission tube, such as a shock tube, to provide an ignition transfer device for transmitting an ignition signal to a detonator. Yet another aspect of the invention provides a detonation device in which the initiation fixture is mounted on one end of an impulse transmission tube having a detonator affixed to the other end.

The present invention provides, in one aspect, an initiation fixture for a shock tube. The fixture comprises a sleeve member having an external mounting surface and a longitudinal internal bore, and having a proximal end and a distal end. The sleeve member is dimensioned and configured to receive in the proximal end an initiating charge and to receive in the distal end a shock tube. The fixture further comprises spacing means within the internal bore of the sleeve member for establishing at least a touch hole between an initiating charge and a shock tube received within the sleeve member. There are also isolation means disposed within the sleeve member for dispersing static electricity from a shock tube received in the distal end of the sleeve member, to isolate an initiating charge received in the proximal end of the sleeve member from static electricity from the shock tube. In addition, there are retaining means rotatably disposed on the mounting surface and dimensioned and configured to engage a percussion igniter device and to dispose the initiating charge in operative relation to the igniter device. Finally, the fixture comprises first stop means disposed on the sleeve member for allowing the retaining means to secure the proximal end of the sleeve member in the igniter device.

According to one aspect of the invention, the spacing means may comprise a fence member having a central aperture. There may also be stand-off spacer means to provide a stand-off space between the proximal end of a shock tube and an initiating charge received within the sleeve member. For example, the stand-off space may be between the touch hole and the proximal end of the shock tube.

According to another aspect of the invention, the initiation fixture may further comprise an initiating charge disposed within the proximal end of the sleeve member.

According to still another aspect of the invention, the initiation fixture may further comprise a shock tube having a proximal end and a distal end, the proximal end of the shock tube being securely received within the distal end of the sleeve member and disposed against the isolation member.

Yet another aspect of the invention provides that the retainer means may be slideably disposed on the mounting surface for longitudinal travel thereon. There may also be second stop means for preventing the retaining means from sliding off the distal end of the sleeve member and to limit the longitudinal travel of the retainer means on the sleeve member. The second stop means may be indexable to permit the user to vary the longitudinal travel of the retaining means.

A different aspect of the invention provides an ignition transfer device comprising an impulse transmission tube having a proximal end to be ignited by an initiating charge in order to generate a signal for propagation through the impuse transmission tube, and having a distal end; and an initiation fixture affixed to the impulse transmission tube at the proximal end thereof. The initiation fixture according to this aspect of the invention comprises (i) an end sleeve having a proximal end and a distal end, the distal end enclosing the proximal end of the impulse transmission tube and providing a mounting surface exteriorly of the impulse transmission tube, (ii) a retainer means slideably carried on the mounting surface for longitudinal travel thereon and dimensioned and configured to be engaged by an igniter device, (iii) first stop means to allow the retainer means to secure the proximal end of the initiation fixture in the igniter device, and (iv) an initiating charge carried by the end sleeve in operative proximity to the proximal end of the impulse transmission tube and accessible for detonation by the igniter device. Thus, the igniter device can detonate the initiating charge to initiate transmission of a signal through the impulse transmission tube.

The device according to this aspect of the invention may further comprise second stop means carried on the end sleeve dimensioned and configured to limit longitudinal travel of the retainer means on the mounting surface. In such case, the retainer means may be disposed between the first and the second stop members.

In any of the foregoing embodiments, the retainer means may comprise a retainer nut rotatably mounted on the mounting surface and having exterior threads formed thereon which are dimensioned and configured to be threadably engaged by the percussion igniter device. In addition, the impulse transmission tube comprises a signal transmission tube, such as a shock tube.

Another aspect of the invention provides a self-contained detonating device wherein a detonator is affixed to the distal end of the impulse transmission tube in the ignition transfer device described above, the detonator being detonatable by the signal propagated through the impulse transmission tube.

Any of the foregoing embodiments may comprise indexable stop means disposed on the end sleeve to allow a user to vary the longitudinal travel of the retainer means.

The following terms used herein and in the claims shall have the indicated meanings.

An "impulse transmission tube" means any detonating or deflagrating signal transmission tube or fuse which can carry a detonating signal or deflagrating signal along its interior. Such detonating signal transmission tubes are commonly referred to as "shock tube" and may be of the type disclosed in Persson U.S. Pat. 3,590,739 or Thureson et al U.S. Pat. No. 4,607,573. A deflagrating signal transmission tube may be of the type disclosed in Thureson U.S. Pat. 4,757,764, the disclosure of which is hereby incorporated herein by reference thereto. Such impulse transmission tubes comprise flexible hollow plastic tubes having an interior coating of a reactive material capable of carrying a detonating or deflagrating signal.

The term "signal" used in connection with a fuse or impulse transmission tube means the detonating shock wave or deflagrating flame front transmitted along the tube and utilized to initiate the pyrotechnic composition of a detonator, sometimes referred to as a blasting cap, which in turn ignites an explosive charge.

The terms "proximal" and "distal" as used herein indicate the relative position of the ends of a device or structure in relation to the intended position of an igniter device. Thus, for example, in a tube having two ends, the end intended to be coupled to an igniter device is the proximal end, and the other end of the tube is the distal end.

DETAILED DESCRIPTION OF THE INVENTION AND PREFERRED EMBODIMENTS THEREOF

The present invention relates to an initiation fixture for an impulse transmission tube which allows a user to easily connect the tube to an igniter device. The distal end of the initiation fixture is securely engageable with the proximal end of the impulse transmission tube, and the other, proximal end of the initiation fixture is dimensioned and configured to receive an initiating charge for igniting the impulse transmission tube. As will be described below, the initiating charge need not be directly attached to the impulse transmission tube, and it may be self-contained. For example, a primer cap may provide the initiating charge. The initiation fixture is dimensioned and configured to dispose the initiating charge and the proximal end of the impulse transmission tube in operable proximity, i.e., disposed so that when the initiating charge is ignited, it in turn initiates a signal in the impulse transmission tube.

Figure 1:
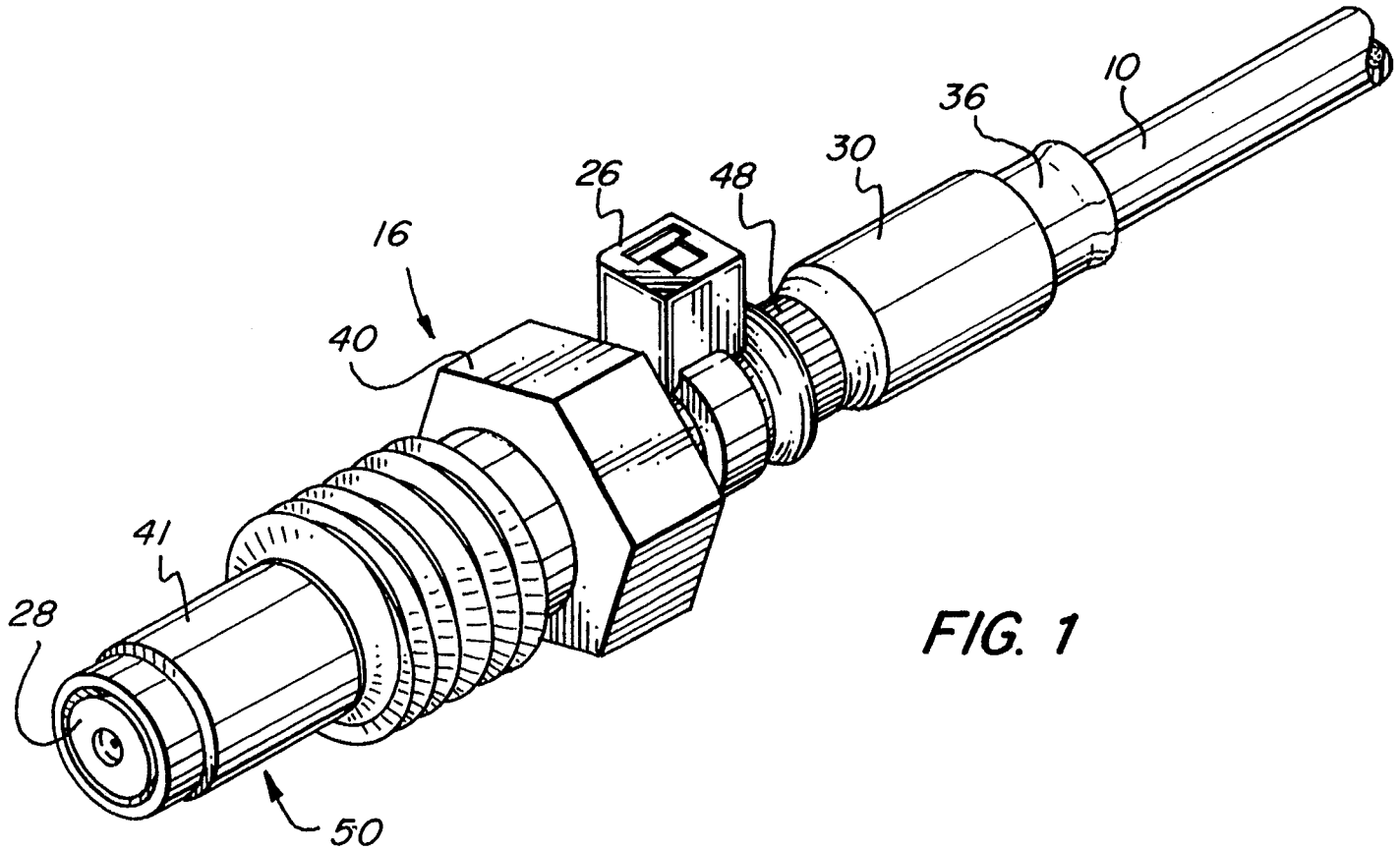
FIG. 1 is a perspective view of one embodiment of an initiation fixture according to the present invention.

The general configuration of one embodiment of an initiation fixture 16 according to the present invention is shown in FIG. 1 wherein initiation fixture 16 is shown attached to one end of a shock tube 10. Shock tube 10 is a conventional shock tube comprising a plastic tube having an outer, resilient layer and an inner, adherent layer, and having a reactive material adhered to the inner surface thereof. Initiation fixture 16 comprises an end sleeve 30 which is generally cylindrical in configuration and which has a longitudinal internal bore. The proximal end of shock tube 10 is inserted into the internal bore of end sleeve 30 with an intervening closure bushing 36. Then, end sleeve 30 is crimped, for example, at crimp 48 to secure end sleeve 30 onto shock tube 10. Closure bushing 36 is wrapped about shock tube 10 at least in the region of crimps 46 (FIG. 2) and 48 to help establish a hermetic seal about shock tube 10, thus inhibiting the access of water into the interior of the shock tube.

The exterior of end sleeve 30 provides a mounting surface (not visible in FIG. 1) on which is disposed retainer means for securing initiation fixture 16 to a triggering device. In the illustrated embodiment, the retainer means is provided by an externally threaded nut 40 which is configured to have a longitudinal internal aperture dimensioned and configured to receive end sleeve 30. End sleeve 30 and the internal aperture of nut 40 are dimensioned and configured to allow nut 40 to travel longitudinally along end sleeve 30. Preferably, mounting surface 38 (seen in FIG. 2) is cylindrical, and nut 40 can rotate about end sleeve 30 to thread into a corresponding threaded fixture in a triggering device without the need to rotate the end sleeve or the impulse transmission tube.

To limit the longitudinal travel of nut 40 in the proximal direction and to provide a means by which nut 40 can dispose primer cap 28 within a triggering device, an end sleeve 30 comprises a stop member such as collar 41 which provides a shoulder 42 (not shown in FIG. 1) against which nut 40 may bear. Thus, when nut 40 is threaded into a triggering device, the proximal end 50 of end sleeve 30 is driven into the device to dispose primer cap 28 in position for firing.

To prevent nut 40 from sliding off of the distal end of end sleeve 30 and down along shock tube 10, a second stop member 26 is secured to end sleeve 30 to limit the longitudinal travel of nut 40. Preferably, stop member 26 is a conventional plastic gathering tie having a ribbed tail and a locking head through which the tail can be pulled and which secures the tail therein. Alternatively, other stop means may be used in place of a gathering tie, e.g., a C-ring may be clamped around end sleeve 30 to provide a stop for nut 40, or a boss may be attached, e.g., by soldering, to the end sleeve for this purpose. Plastic gathering ties are preferred as stop members because they can be easily and securely attached to the end sleeve but are also easily removed by a user desiring to lend a greater degree of longitudinal travel to nut 40. Preferably, the gathering tie is cinched about a crimp (not shown) on end sleeve 30 to secure the tie thereon.

The internal bore of end sleeve 30 defines a cap receptacle at its proximal end dimensioned and configured to receive an initiating charge, which is preferably self-contained, such as a primer cap 28. Preferably, the proximal end of end sleeve 30 is dimensioned and configured to provide a friction fit for primer cap 28, thus sealing off the interior of end sleeve 30. When primer cap 28 is in place, the proximal end of end sleeve 30 may be hermetically sealed by applying a coating of a varnish or similar sealant to the end of the initiation fixture. Thus, closure bushing 36 and the seal at the end of the initiation fixture together provide a hermetically sealed closure for the interior of shock tube 10 which is exposed at the proximal end thereof and permits reliable signal transmission in otherwise adverse conditions, e.g., under water.

Figure 2:
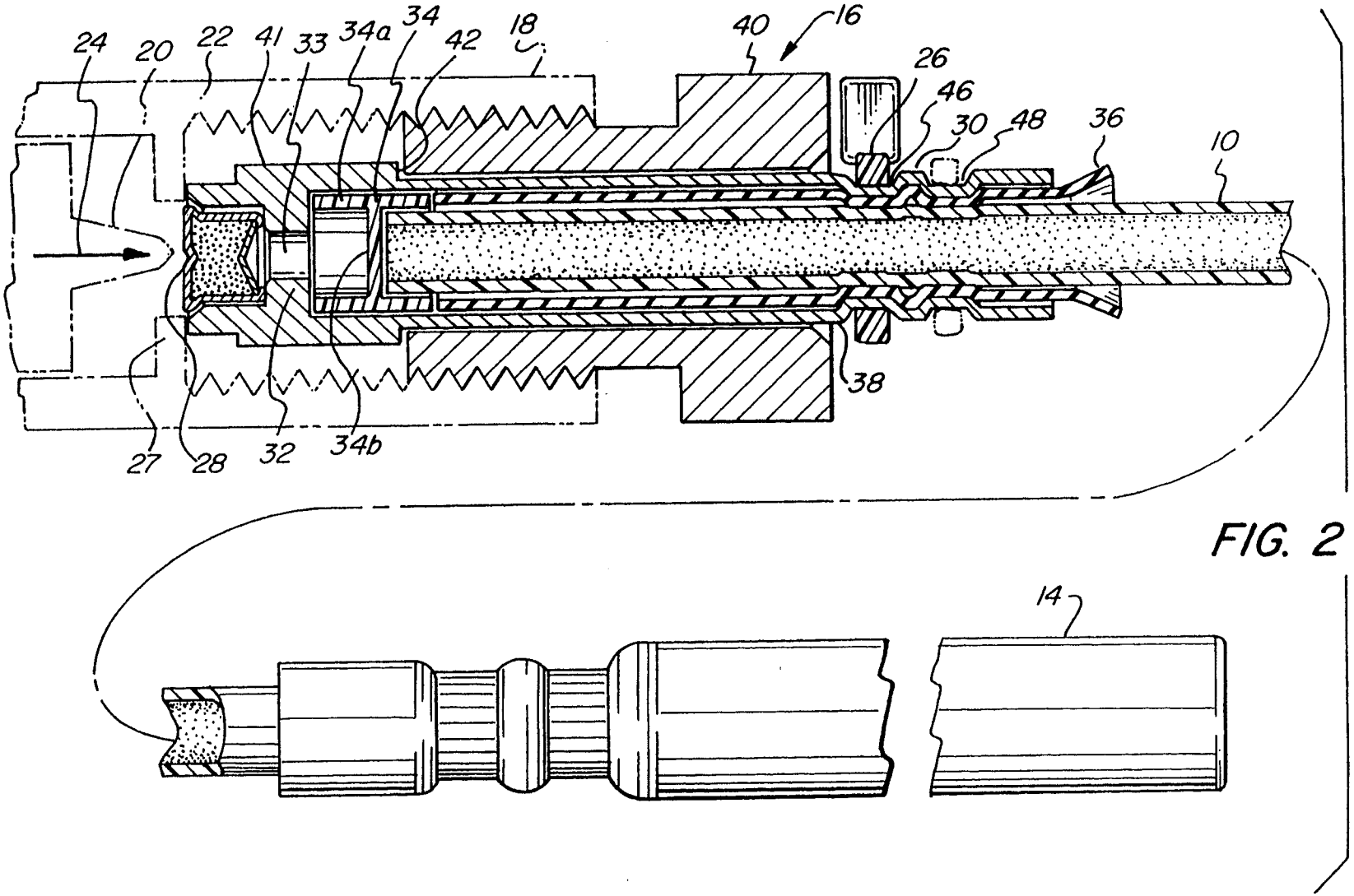
FIG. 2 is a schematic, partially cross-sectional view enlarged with respect to FIG. 1 of the impulse transmission tube of FIG. 1, showing the initiation fixture engaged with a percussion igniter device.

The structure of initiation fixture 16 is shown in greater detail in FIG. 2 where it is seen coupled to an igniter or triggering device 18 (shown in phantom lines) which may be, for example, a spring-loaded flare gun. Such devices typically comprise a striking pin 20 which is movable within a barrel 22 and which is spring-loaded to move in the direction of arrow 24 to strike an initiating charge. As illustrated, striking pin 20 passes through a central aperture in stop 27 to strike primer cap 28.

To facilitate the initiation of a signal in a shock tube by an initiating charge, the interior of end sleeve 30 is configured to have an annular internal fence 32 having a central aperture. The internal bore of end sleeve 30 on the proximal side of fence 32 is dimensioned and configured to receive the initiating charge, e.g., primer cap 28, which is detonatable by the physical impact of the striking pin of triggering device 18. As illustrated in FIG. 2, fence 32 physically separates primer cap 28 from the proximal end of shock tube 10, and the central aperture therein thus provides a touch hole 33 having a diameter smaller than the diameter of primer cap 28 for transferring the energy released upon detonation of primer cap 28 toward the proximal end of shock tube 10.

An isolation member 34 is disposed against the distal side of fence 32. Isolation member 34 has a cylindrical circumferential portion **34*a* and a medial membrane portion 34*b*. The interior of cylindrical portion 34*a* is dimensioned and configured to receive the end of shock tube 10, which bears against membrane portion 34*b* of isolation member As is known in the art, isolation member 34 serves to disperse static electricity which may develop through the handling of shock tube 10, thus preventing the electricity from discharging from the end of shock tube 10 directly to primer cap 28 and causing premature detonation of the device. Such an isolation member is disclosed in U.S. Pat. No. 3,981,240 to Gladden, which is hereby incorporated herein by reference. As seen in FIG. 2, closure bushing 36 may engage the edge of the cylindrical portion 34*a* of isolation member 34**.

By properly configuring primer cap 28 and internal fence 32, initiation fixture 16 of the present invention provides a touch hole 33 which focuses the detonation energy of primer cap 28 toward the proximal end of shock tube 10, so that upon detonation, primer cap 28 ruptures membrane **34*b* and ignites the reactive material disposed within shock tube 10. Since the detonation energy of primer cap 28 is focused in this way, the quantity of detonatable material contained within primer cap 28 required to initiate a signal in shock tube 10 may be kept to a minimum. For example, in a particular embodiment, the initiation fixture is dimensioned and configured to receive a relatively low-strength primer cap available from Olin Corporation under the designation M42C1. The M42C1 primer cap is described as containing a nominal 0.34 grains of a lead styphnate-tetracene, non-corrosive-type priming mixture. Correspondingly, fence 32 has a thickness of 3.2 mm (0.125 inches) and touch hole 33 has a diameter of 1.8 mm (0.07 inches). Isolation member 34 also advantageously provides a stand-off space between the proximal end of shock tube 10 and touch hole 33 in fence 32. The stand-off space attenuates the force of the impulse created upon the detonation of primer cap 28 by providing an expansion space for the gases produced upon detonation of the primer cap, which could otherwise expel shock tube 10 from the initiation fixture or blow out the signal in the shock tube. Thus, in addition to dispersing static electricity, isolation member 34 increases the reliability of the initiation fixture when used with a shock tube and helps retain shock tube 10 within the end sleeve 30 of initiation fixture 16 so that the detonation of primer cap 28 and the transmission of the signal through shock tube 10** may be accomplished in virtual silence. With other impulse transmission tubes or with black powder fuses, it may not be necessary to provide an isolation member, a touch hole or a stand-off space from the initiating charge, which may comprise a pyrotechnic material rather than an explosive charge. In some embodiments, the initiating charge and the impulse transmission tube may be in direct contact with each other.

The foregoing description illustrates another feature of the present invention, i.e., that the initiating charge need not be integrally incorporated onto the end of the impulse transmission tube. Rather, a self-contained initiating charge such as a primer cap can be separately prepared and mounted in the initiation fixture. In addition, there is no need to specially prepare the end of the impulse transmission tube to receive or engage the initiating charge, e.g., there is no need to strip away any part of the outer casing of shock tube 10 to expose an inner core to engage the initiating charge. Rather, the impulse transmission tube can be simply and easily sheared and inserted into end sleeve 30. In view of these features, it will be understood that an initiation fixture according to the present invention can easily be adapted to accommodate various self-contained initiating charges, and impulse transmission tubes of varying strengths and physical configurations, As discussed above, stop means such as collar 41 and stop member 26, which is seated in crimp 46, limit the longitudinal travel of nut 40 along end sleeve 30. In the illustrated embodiment, the stop means are preferably separated by a distance which exceeds the longitudinal dimension of nut 40 to a degree sufficient to allow nut 40 to rotate about end sleeve 30 with a minimum of resistance.

In some applications, it may be desirable to allow a greater degree of longitudinal travel than in others, and in such cases stop member 26 may be disposed within a more distal crimp 48, as suggested in dotted outline. For greater longitudinal travel, stop member 26 may be disposed even further from the proximal end of the initiation fixture 16, or it may be removed completely. The additional longitudinal travel is useful in coupling the initiation fixture to certain triggering devices that comprise a retaining clamp which directly engages shoulder 42 to dispose initiation fixture 16 and primer cap 28 in position for firing. In some such devices, it is necessary to provide clearance between nut 40 and shoulder 42 so that the clamp can engage shoulder 42 without interference from nut 40. Some users of such triggering devices prefer that stop member 26 be removable so that nut 40 can be positioned well out of the way of the retaining clamp. However, in the preferred embodiment, the stop members are positioned so as to limit the longitudinal travel of nut 40 to that required to permit easy rotation of nut 40 on end sleeve 30. Limiting the longitudinal travel can be important when the retaining means fails to dispose the primer cap 28 firmly in position for initiation.

In ideal circumstances, the full engagement of the retaining means such as nut 40 with triggering device 18 disposes primer cap 28 firmly in position as nut 40 bears against shoulder 42, as shown in FIG. 2. In so doing, nut 40 forces end sleeve 30 to bear against stop 27, securely positioning primer cap 28 to receive the full impact of striking pin 20. However, in the event that stop 27 becomes damaged through use or is mis-positioned during manufacture, end sleeve 30 may not bear directly upon stop 27 even though nut 40 is in full engagement with barrel 22. In such case, end sleeve 30 will be able to travel within nut 40 toward stop 27 because nut 40 is slideably disposed on mounting surface 38. Thus, the energy of impact otherwise fully imparted by striking pin 20 to primer cap 28 will be diminished as it is at least partly expended in pushing end sleeve 30 through nut 40 to the point where shoulder 42 bears against nut 40. If the travel of end sleeve 30 within nut 40 is excessive, the diminution in impact energy may be so severe that primer cap 28 fails to ignite. By positioning stop member 26 from shoulder 42 at a distance which minimizes the longitudinal travel of nut 40 relative to end sleeve 30, the loss of impact energy is reduced and the risk of misfire is thus lessened, The multiple crimps can be used to allow the user to set the desired degree of longitudinal travel. For example, a stop means such as stop member 26 could be disposed in both crimps 46 and 48, providing at first a limited degree of travel between shoulder 42 and stop member 26. Should a user desire more travel, the proximal stop member 26 could be removed, leaving the more distal stop member in crimp 48 as the travel-limiting structure. Alternatively, a movable stop means such as an expandable C-spring could be emplaced in crimp 46 and later moved to crimp 48 or another crimp which may be provided on end sleeve 30, as desired. Thus, one aspect of the invention provides indexable stop means to allow the user to vary the degree of longitudinal travel of the retaining means on the end sleeve.

As seen in FIG. 2, shock tube 10 not only has an initiation fixture 16 attached to its proximal end, but it also has a detonator cap 14 fixedly attached to its distal end. Detonator cap 14 contains an explosive material which is ignitable by shock tube 10 and which has sufficient explosive force to detonate a primary charge or ignite a pyrotechnic device such as a rocket motor. Detonator cap 14 is crimped to shock tube 10 with an intervening closure bushing in the same manner as is end sleeve 30, and it is configured to have a sealed end, so shock tube 10 is hermetically sealed at both ends. Detonator cap 14 may be any conventional type of initiating device, including, e.g., a miniature detonator used to detonate detonating cord, a low-strength transmitting cap or a high-strength blasting cap. Thus, one aspect of the invention provides a self-contained detonating device which detonates a primary charge upon the receipt of an initiation signal.

In use, initiation fixture 16 is used to couple shock tube 10 to a triggering device 18 such as a flare gun in a manner which allows triggering device 18 to detonate an initiating charge disposed within initiation fixture 16, such as primer cap 28, by the percussive strike of striking pin 20. Primer cap 28 detonates shock tube 10, which carries the signal along its length to detonator cap 14 which is detonated thereby. Detonator cap 14, in turn, initiates the primary device, e.g., an explosive charge, a rocket motor, etc.

Figure 3:
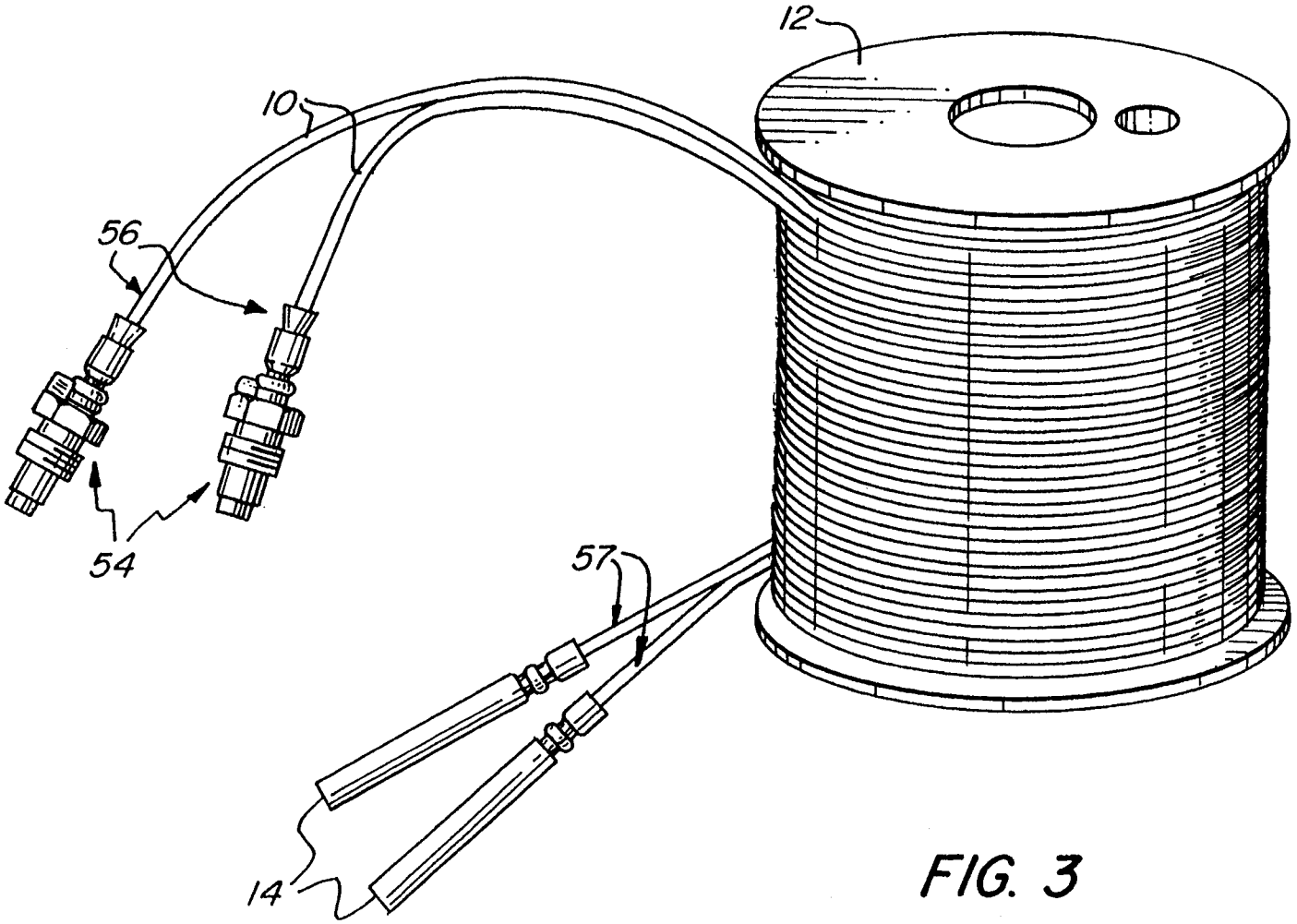
FIG. 3 is a perspective view of an impulse transmission tube wound about a spool and comprising an initiation fixture and a detonating cap according to another embodiment of the present invention.

A detonating device according to the invention is shown in FIG. 3, which shows a redundant detonating device having a pair of shock tubes 10 wound about a spool 12. The shock tubes have initiation ends 56 onto which initiation fixtures 54 containing discrete, self-contained initiating charges are hermetically sealed. Initiation fixtures 54 may optionally be configured as described above. The shock tubes have detonator ends 57 on which detonator caps 14 are also hermetically attached. The user couples at least one but optionally both of initiation fixtures 54 to a dual igniter device and runs the shock tubes 10 to a device comprising a primary charge having a coupling to receive the detonator caps 14.

Thus, one aspect of the invention provides an ignition transfer device which may be entirely self-contained in that it comprises an impulse transmission tube having an initiating charge at the proximal end and a detonating charge attached at the distal end. Such a fixture can be used by field personnel to operably connect an igniter device such as a flare gun to a distant primary explosive charge by coupling a device comprising an initiating charge, an impulse transmission tube and a detonator between them without the need to assemble complicated or cumbersome connections in the field or to breach any part of the tube. The invention is therefore particularly useful in applications where connections between igniter devices and primary charges must be made quickly, where environmental conditions may be severe, e.g., in inclement weather or under water, and where it is desired to keep detonation noises to a minimum.

While the invention has been described in detail with reference to a particular embodiment thereof, it will be apparent that upon a reading and understanding of the foregoing, numerous alterations to the described embodiment will occur to those skilled in the art and it is intended to include such alterations within the scope of the appended claims.

What is claimed is:

1. An initiation fixture for a shock tube, comprising:

a sleeve member having an external mounting surface and a longitudinal internal bore, and having a proximal end and a distal end, the sleeve member being dimensioned and configured to receive in the proximal end an initiating charge and to receive in the distal end a shock tube;

spacing means within the internal bore of the sleeve member for establishing at least a touch hole between an initiating charge and a shock tube received within the sleeve member;

an isolation means disposed within the sleeve member for dispersing static electricity from a shock tube received in the distal end of the sleeve member, whereby to isolate an initiating charge received in the proximal end of the sleeve member from static electricity from the shock tube;

retaining means rotatably disposed on the mounting surface and dimensioned and configured to engage a percussion igniter device and to dispose the initiating charge in operative relation to the igniter device; and first stop means disposed on the sleeve member to allow the retaining means to secure the proximal end of the sleeve member in the igniter device.

2. The fixture of claim 1 wherein the spacing means comprises a fence member having a central aperture to define the touch hole.

3. The fixture of claim 1 or claim 2 further comprising stand-off spacer means to provide a stand-off space between the proximal end of a shock tube and an initiating charge received within the sleeve member.

4. The fixture of claim 3 wherein the stand-off spacer means is dimensioned and configured so as to position the stand-off space between the touch hole and the shock tube.

5. The fixture of claim 4 further comprising an initiating charge disposed within the proximal end of the sleeve member.

6. The fixture of claim 5 further comprising a shock tube having a proximal end and a distal end, the proximal end of the shock tube being securely received within the distal end of the sleeve member and disposed against the isolation member.

7. The fixture of claim 4 wherein the retainer means is slideably disposed on the mounting surface for longitudinal travel thereon.

8. The fixture of claim 7 further comprising second stop means for preventing the retaining means from sliding off the distal end of the sleeve member and to limit the longitudinal travel of the retainer means on the sleeve member.

9. The fixture of claim 8 wherein the second stop means comprises an indexable stop means for varying the longitudinal travel of the retaining means.

10. An ignition transfer device comprising:

(a) an impulse transmission tube having a proximal end to be ignited by an initiating charge in order to generate a signal for propagation through the impulse transmission tube, and having a distal end; and (b) an initiation fixture affixed to the impulse transmission tube at the proximal end thereof, the initiation fixture comprising (i) an end sleeve enclosing the proximal end of the impulse transmission tube and providing a mounting surface exteriorly of the impulse transmission tube, (ii) a retainer means slidably carried on the mounting surface for longitudinal travel thereon and dimensioned and configured to be engaged by an igniter device, (iii) first stop means to allow the retainer means to secure the proximal end of the end sleeve in an igniter device, (iv) an initiating charge carried by the end sleeve in operative proximity to the proximal end of the impulse transmission tube and accessible for detonation by the igniter device, whereby to initiate transmission of a signal through the impulse transmission tube, and (v) the device further comprising second stop means carried on the end sleeve dimensioned and configured to limit longitudinal travel of the retainer means on the mounting surface without engaging the igniter device.

11. The device of claim 10 wherein the retainer means comprises a retainer nut rotatably mounted on the mounting surface and having exterior threads formed thereon which are dimensioned and configured to be threadably engaged by the igniter device.

12. The device of claim 10 wherein the retainer means is disposed between the first and the second stop members.

13. The device of claim 10 or claim 12 wherein the impulse transmission tube comprises a detonating signal transmission tube.

14. The device of claim 10 further including a detonator affixed to the distal end of the impulse transmission tube for detonation by the signal propagated through the impulse transmission tube.

15. A device of claim 14 wherein at least one of the initiation fixture and the detonator comprises sealing means for establishing a water-tight seal with at least one end the impulse transmission tube.

16. The device of claim 10, claim 12, claim 14 or claim 16 wherein the initiating charge comprises a primer cap and wherein the end sleeve defines a cap receptacle at the proximal end thereof within which a primer cap is disposed, and further defines a touch hole leading from the primer cap to the proximal end of the impulse transmission tube, the touch hole being of lesser diameter than the primer cap whereby to concentrate the energy released upon detonation of the primer cap onto a smaller area of the proximal end of the impulse transmission tube than would be the case in the absence of the touch hole.

17. The device of claim 2, claim 10 or claim 15 further comprising indexable stop means disposed on the end sleeve to allow a user to vary the longitudinal travel of the retainer means.

* * * * *

UNITED STATES PATENT AND TRADEMARK OFFICE

CERTIFICATE OF CORRECTION

PATENT NO. : 5,365,851

DATED : November 22, 1994

INVENTOR(S) : Lester W. Shaw

It is certified that error appears in the above-indentified patent and that said Letters Patent is hereby corrected as shown below:

In column 2, line 36, replace "impuse" with -- impulse--.

In column 5, line 42, between "member" and "As", insert --34. --.

In claim 15, replace "A device" with --The device--.

In claim 16, replace "claim 16" with --claim 15--.

Signed and Sealed this

Thirty-first Day of October 1995

*Attest:*

*Attesting Officer*

BRUCE LEHMAN

*Commissioner of Patents and Trademarks*